US008550661B2

(12) United States Patent
Sonobe

(10) Patent No.: US 8,550,661 B2
(45) Date of Patent: Oct. 8, 2013

(54) LIGHTING APPARATUS

(75) Inventor: Ryuta Sonobe, Tokyo (JP)

(73) Assignee: Yamagata Promotional Organization for Industrial Technology, Yamagata-shi (JP)

( * ) Notice: Subject to any disclaimer, the term of this patent is extended or adjusted under 35 U.S.C. 154(b) by 166 days.

(21) Appl. No.: 12/396,322

(22) Filed: Mar. 2, 2009

(65) Prior Publication Data

US 2009/0219718 A1 Sep. 3, 2009

(30) Foreign Application Priority Data

Feb. 29, 2008 (JP) ..... 2008-049422

(51) Int. Cl.
*F21V 21/00* (2006.01)

(52) U.S. Cl.
USPC ..... 362/249.06; 362/249.11; 362/249.14; 362/249.16; 362/84; 362/147

(58) Field of Classification Search
USPC ..... 362/249.06, 249.11, 249.14, 249.16, 362/84, 147, 153, 800, 806
See application file for complete search history.

(56) References Cited

U.S. PATENT DOCUMENTS

| | | | | |
|---|---|---|---|---|
| 3,634,678 | A | 1/1972 | Glass et al. | |
| 6,183,100 | B1 * | 2/2001 | Suckow et al. | 362/35 |
| 6,483,254 | B2 * | 11/2002 | Vo et al. | 315/241 S |
| 7,079,041 | B2 * | 7/2006 | Fredericks et al. | 340/815.45 |
| 7,108,392 | B2 * | 9/2006 | Strip et al. | 362/145 |
| 7,168,827 | B2 * | 1/2007 | Stein et al. | 362/299 |
| 7,841,741 | B2 * | 11/2010 | Chan et al. | 362/249.04 |
| 2003/0038291 | A1 | 2/2003 | Cao | |
| 2006/0126328 | A1 * | 6/2006 | Coushaine | 362/247 |
| 2009/0027889 | A1 * | 1/2009 | Kang et al. | 362/294 |

FOREIGN PATENT DOCUMENTS

| | | | |
|---|---|---|---|
| CN | 101025257 | A | 8/2007 |
| CN | 201000010 | Y | 1/2008 |
| EP | 1431656 | A2 | 6/2004 |
| JP | 2006-147262 | A | 6/2006 |
| JP | 2007-173424 | A | 7/2007 |

OTHER PUBLICATIONS

Chinese Office Action dated Oct. 10, 2011, issued in corresponding Chinese Patent Application No. 200910117960.
European Search Report dated Apr. 20, 2010, issued in corresponding European Patent Application No. 09002852.3.

* cited by examiner

*Primary Examiner* — Jong-Suk (James) Lee
*Assistant Examiner* — Mark Tsidulko
(74) *Attorney, Agent, or Firm* — Westerman, Hattori, Daniels & Adrian, LLP

(57) ABSTRACT

To provide a lighting apparatus in which a high-class feeling and a cubic effect are obtained or an interior design is allowed to have an appearance like a chandelier. Plane light emitters constituted by organic EL elements are mounted at planar frames in the shape of a frame, and the above-mentioned frames are connected mutually and annularly so that light emitting units of a first-third rings are arranged. Each of the above-mentioned frames which constitute the light emitting units of each ring is formed to be square, and opposed corner portions of the respective frames are connected together. The numbers of frames which constitute the light emitting units of the above-mentioned first-third rings are each set as the same number, and a plane light emitter side in each frame is arranged so as to form a dome shape.

5 Claims, 6 Drawing Sheets

LIGHTING APPARATUS

BACKGROUND OF THE INVENTION

1. Field of the Invention

The present invention relates to a lighting apparatus using a plane light source represented by, for example, an organic EL (electroluminescence) element.

2. Description of the Related Art

Since an organic EL element is driven by a low DC voltage, it has a high luminous efficiency and can be reduced in weight and thinned, as well as it has a feature that it generates substantially no heat. Therefore, it is used for a flat panel display (FPD) in some portable devices etc. By employing the element as a plane light source, it is also arranged to be used as, for example, a back light of a liquid crystal display element.

Further, by selection of a material used for an EL luminescence layer, the above-mentioned organic EL element may provide luminescence colors of R (red), G (green), B (blue), or others. Therefore, by using each of the above-mentioned luminescence colors independently or combining a plurality of types of luminescence colors, white or near white luminescence color may be obtained. Thus, by constructing the organic EL element as the plane light source (light emitting panel), it can be used as the light source for decoration and an efficient light source which illuminates the interior of a room etc.

Japanese Patent Application Publication No. 2007-173424 discloses a ceiling-mounted lighting apparatus in which the above-mentioned organic EL element is formed as a circular or ring-shaped plane light emitter.

Incidentally, according to the lighting apparatus as disclosed in Japanese Patent Application Publication No. 2007-173424, it aims to providing a lighting apparatus which omits an outer frame and emits light to an edge, taking advantage of the feature of the above-mentioned organic EL element.

For this reason, an engaging portion to be engaged with a ceiling hook attached to the ceiling is provided in the central portion of the lighting apparatus. Further, Japanese Patent Application Publication No. 2007-173424 discloses that a light emitting unit having the organic EL element formed in the shape of a ring may be in the shape of a single ring or may be divided into a plurality narrow rings, and that the light emitting unit may be formed so as to further extend radially from the center.

However, in the above-mentioned lighting apparatus, it only suggests that a luminescence pattern in a flat luminescence surface is devised, and it has no distinctions, lacks a cubic effect, and remains monotonous in the devised range of the above-mentioned luminescence pattern. Therefore, it is impossible to allow the illumination to give a gorgeous stage effect etc.

SUMMARY OF THE INVENTION

The present invention arises in view of the above-mentioned problem, and aims at providing a lighting apparatus in which a large number of plane light emitters represented by organic EL elements are arranged in a specific configuration so that a high-class feeling and a cubic effect are obtained, or a gorgeous interior design may be allowed to have an appearance like a chandelier, so to speak.

The lighting apparatus in accordance with the present invention made in order to solve the above-mentioned problem is characterized by being provided with light emitting units of a plurality of rings including at least the light emitting units of a first ring arranged such that a plurality of planar frames each having mounted thereon a plane light emitter are connected mutually and annularly, and the light emitting units of a second ring arranged such that a plurality of planar frames each having mounted thereon a plane light emitter are connected mutually and annularly, each frame circumscribing a perimeter of a respective one of the above-mentioned frames which constitute the light emitting unit of the above-mentioned first ring.

In this case, it is desirable that the plane light emitter sides in the frames which constitute the light emitting units of the above-mentioned rings are arranged to form a dome shape. Further, it is preferably arranged that the numbers of the frames which constitute the light emitting units of the respective rings are set as the same number for the light emitting units of the respective rings.

Further, in a preferred embodiment, it is constituted by the light emitting units of the first-third rings, each of the above-mentioned frames which constitute the light emitting units of each ring is formed to be square, and opposed corner portions of the respective frames are connected together annularly, so that the light emitting units of the above-mentioned first-third rings are respectively arranged. It is desirable that the plane light emitter to be mounted to one surface of each of the above-mentioned planar frames is constituted by an organic EL element.

According to the above-mentioned lighting apparatus, the planar frames having mounted thereon the plane light emitter are connected mutually and annularly so that the light emitting units of one ring are arranged, and a plurality of light emitting units of other rings are similarly arranged and formed concentrically, so to speak. Therefore, a stainless steel plate may be used for the planar frames which constitute the light emitting units of each of the above-mentioned rings, and subjected to decoration processing, such as for example hairline processing etc., so that the lighting apparatus can be provided having a high-class feeling and a stately feeling, or having an appearance like a chandelier, so to speak.

In addition, a mounting side of the plane light emitter in each frame is arranged to form a dome shape, so that a cubic effect can be obtained further and it is possible to realize the lighting apparatus which can aim at giving a gorgeous interior design, a good stage effect, and a good atmosphere.

Further, it is possible to realize the lighting apparatus in which an organic EL element can be used as a plane light emitter to be mounted to each of the above-mentioned frames, a high luminous efficiency can be obtained by means of a low-voltage drive power source without heat generation, and an excellent decoration effect can be obtained as compared with an image of the lighting apparatus using a conventional fluorescent light, an electric bulb, etc.

DESCRIPTION OF THE PREFERRED EMBODIMENTS

Figure 1:
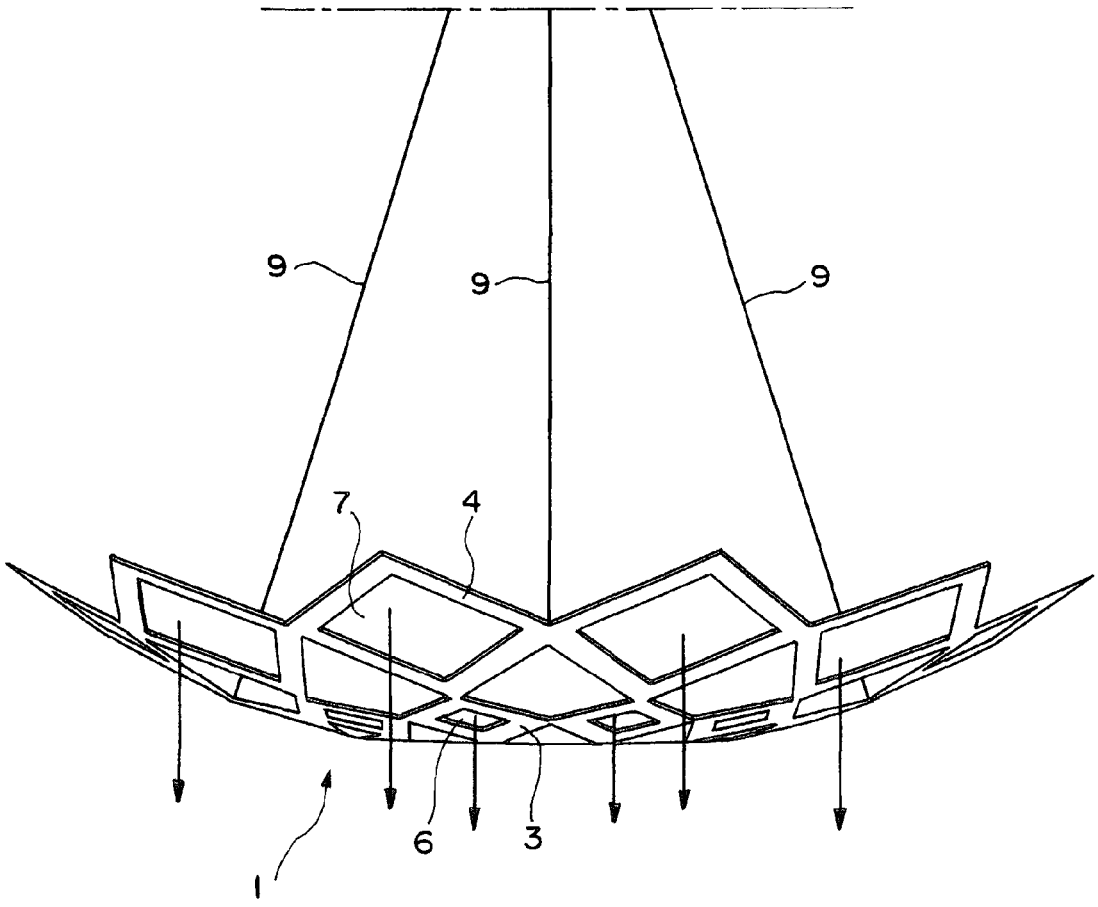
FIG. 1 is a front view in a situation where the present invention is applied to a hung-type lighting apparatus.
Figure 2:
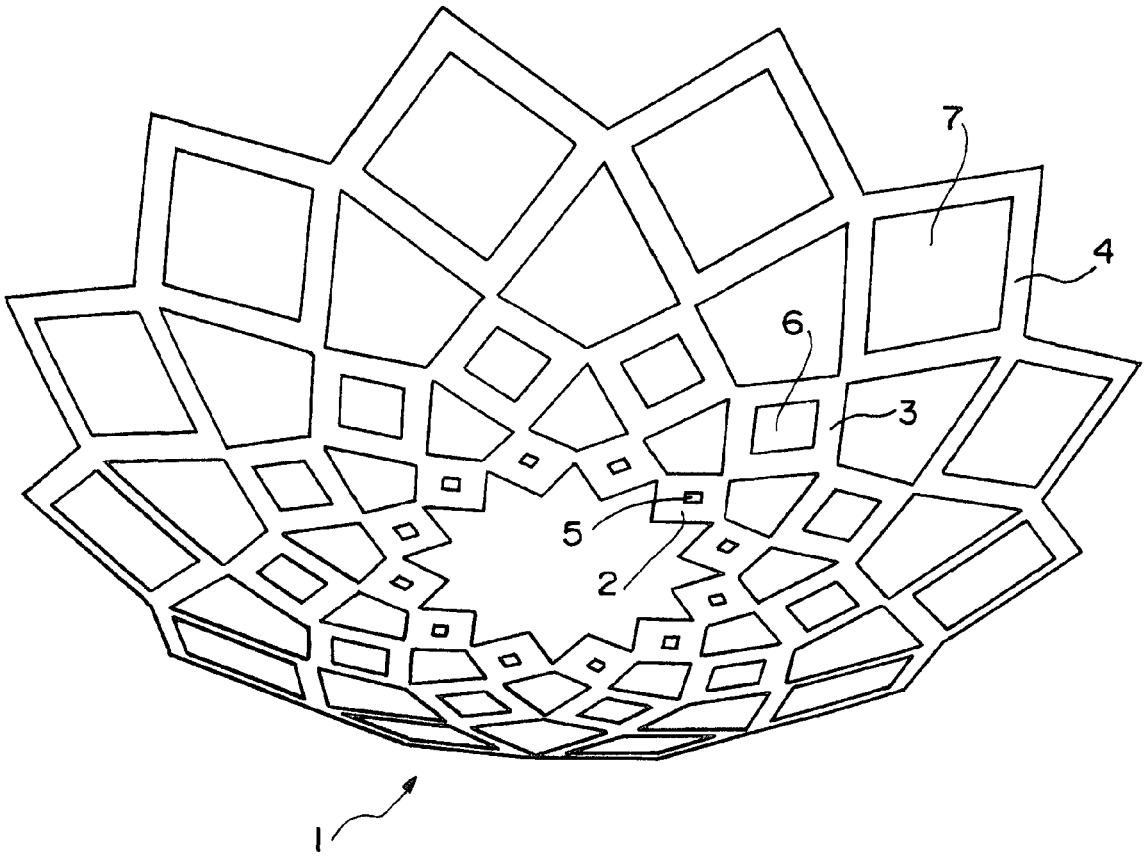
FIG. 2 is a perspective view from below of the device with some angle.
Figure 3:
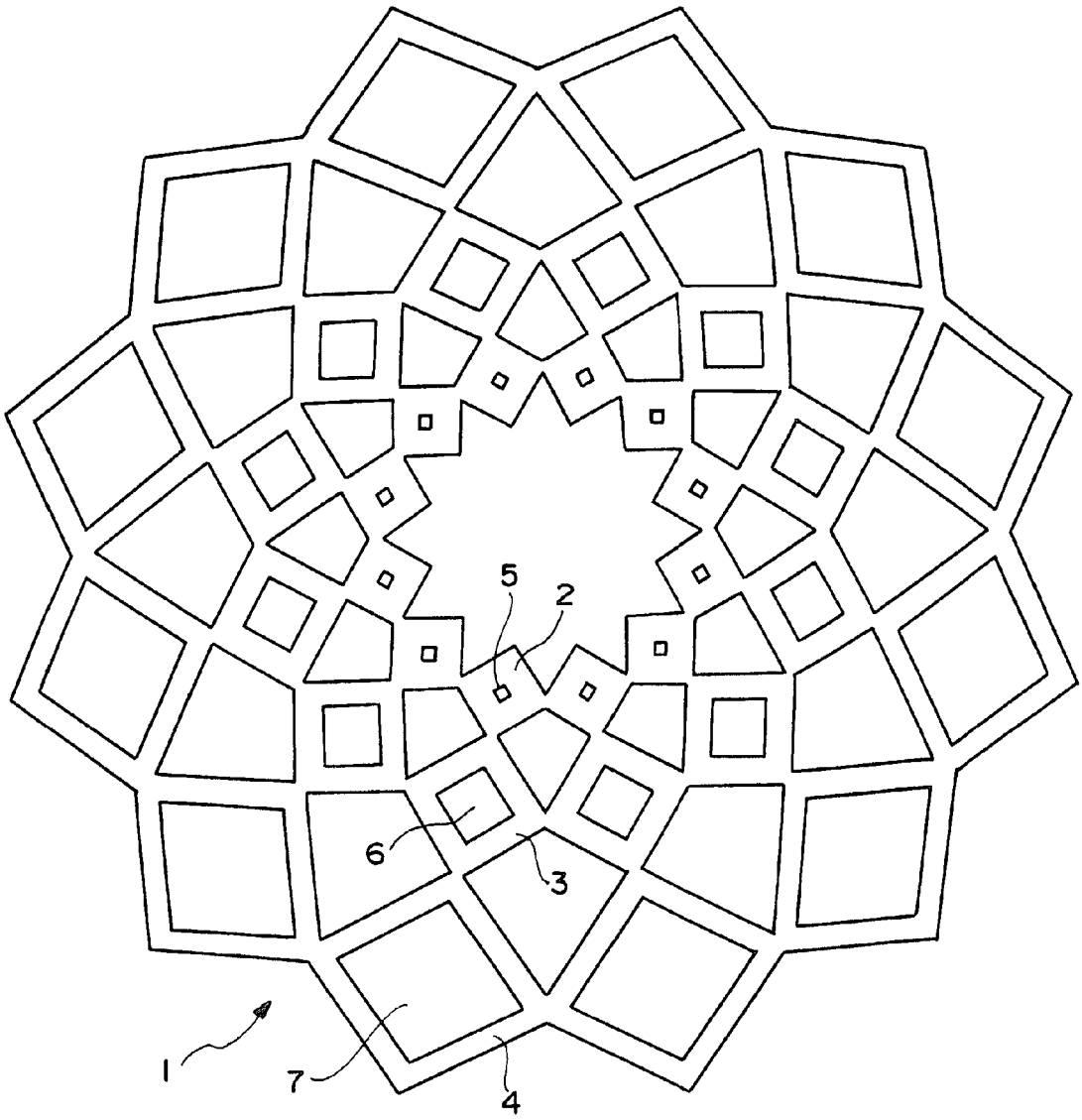
FIG. 3 is a bottom plan view of the device.
Figure 4:
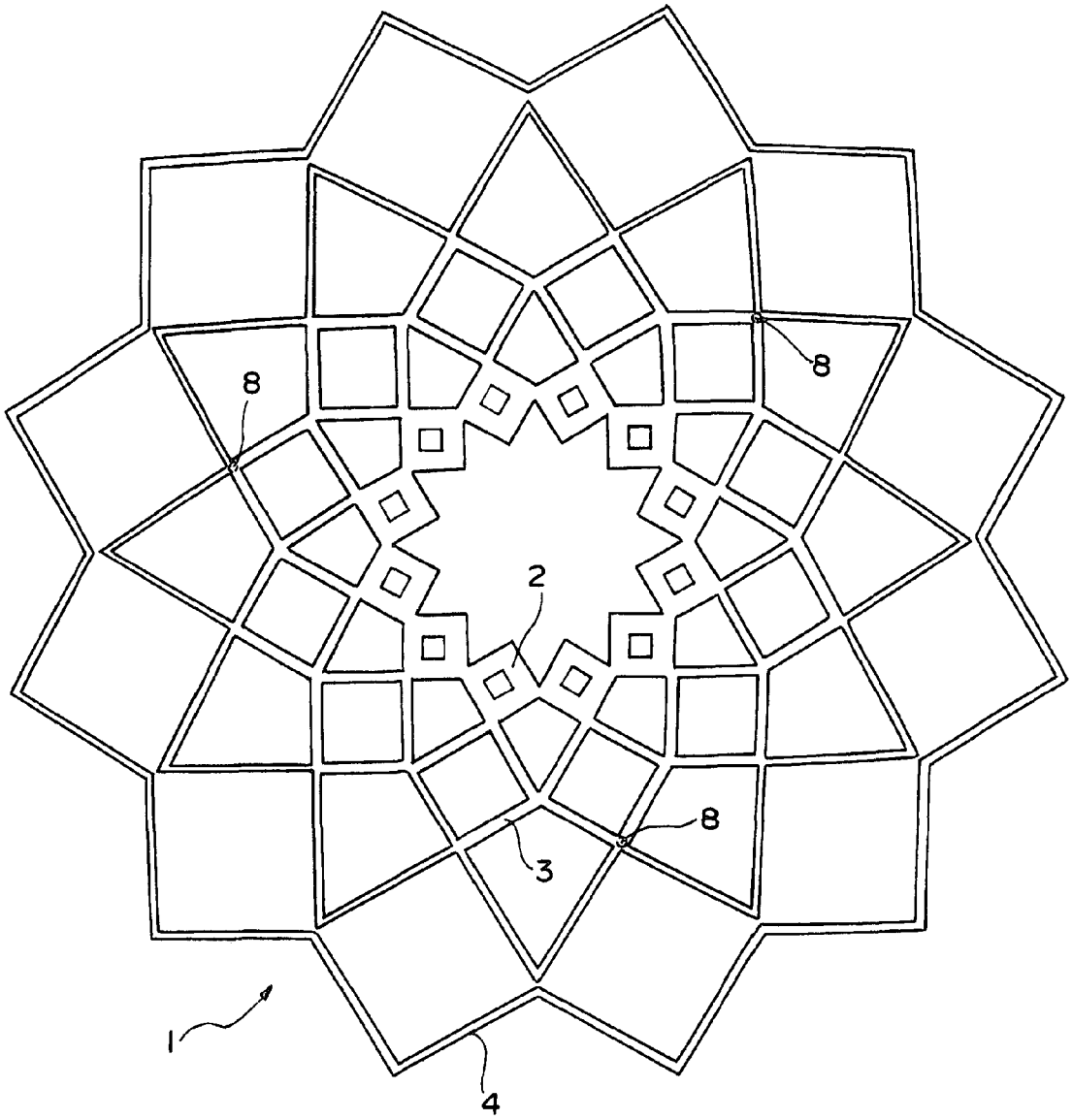
FIG. 4 shows a schematic view of a structure of the device.

Hereafter, a lighting apparatus in accordance with the present invention will be described with reference to the preferred embodiment shown in the drawings. FIGS. 1-4 show a general structure in which the present invention is applied to a ceiling-hung lighting apparatus, where FIG. 1 is a front view, FIG. 2 is a perspective view from below of the device with some angle, FIG. 3 is a bottom plan view, and FIG. 4 is a top view showing a schematic structure.

Hereinafter, a structure of each part in which the same portion is indicated by the same reference numeral will be described with reference to reference numerals. It should be noted that, in order to avoid complications, in each drawing as will be explained, only typical elements are shown by the reference numerals and some of the reference numerals are suitably omitted according to the drawing.

Reference numeral 1 shows a lighting apparatus in accordance with the present invention. As shown in FIG. 1, this lighting apparatus is hung by three wires 9 which are attached at one end to a ceiling surface (not shown). This lighting apparatus 1 is arranged so that light emitting units of respective rings formed by mutually and annularly connecting a plurality of planar frames each having mounted thereon a plane light emitter may be connected concentrically.

That is, in this preferred embodiment, the light emitting units of the first to third rings are arranged and connected concentrically, and reference numeral 2 shows one of the planar frames which constitute the light emitting units of the first ring in the innermost periphery. Further, reference numeral 3 shows one of the planar frames which constitute the light emitting units of the second ring formed outside the light emitting units of the above-mentioned first ring. Furthermore, reference numeral 4 shows one of the planar frames which constitute the light emitting units of the third ring formed further outside the light emitting unit of the above-mentioned second ring.

An outer shape of each of the frames which constitute the light emitting units of the above-mentioned first to third rings is substantially square. Twelve (which is the same number) frames are each used for the light emitting units of the first to third rings. Therefore, a frame 2 constituting the light emitting unit of the first ring which is the innermost periphery is arranged to have the smallest outer shape, and the frames 3 and 4 which respectively constitute the light emitting units of the second and third rings are arranged to have larger outer shapes in order.

Further, as for the respective frames 2 which constitute the light emitting units of the first ring, opposed corner portions are connected together annularly so that the light emitting units of the above-mentioned first ring are arranged. Furthermore, as for the respective frames 3 which constitute the light emitting units of the second ring, opposed corner portions are similarly connected together annularly so that the light emitting units of the above-mentioned second ring are arranged, and these frames 3 are each connected at opposed corner portions of the frames 2 and 3 so as to circumscribe a perimeter of each of the above-mentioned frames 2 which constitute the light emitting units of the first ring.

Still further, as for the respective frames 4 which constitute the light emitting units of the third ring, opposed corner portions are similarly connected together annularly so that the light emitting units of the above-mentioned third ring are arranged, and these frames 4 are each connected at opposed corner portions of the frames 3 and 4 so as to circumscribe a perimeter of each of the above-mentioned frames 3 which constitute the light emitting units of the second ring.

Further, plane light emitters to be mentioned later 5, 6, and 7 sides in the respective frames 2, 3, and 4 which constitute the light emitting units of the above-mentioned respective rings are arranged so as to form a dome shape. In other words, as shown in FIG. 1, in the case where the lighting apparatus 1 is hung, a central part side of the lighting apparatus is arranged to project gradually downwards. In addition, FIG. 4 is a top view showing a schematic structure, and reference numeral 8 shows attachment parts for three wires 9 as shown in FIG. 1.

Figure 5:
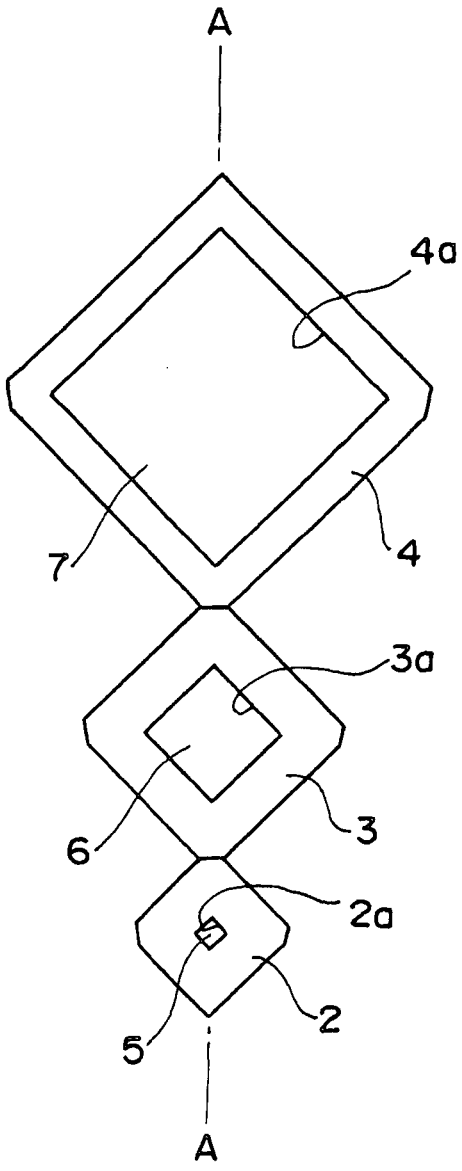
FIG. 5 is a front view showing an example in which frames are combined into a unit.
Figure 6:
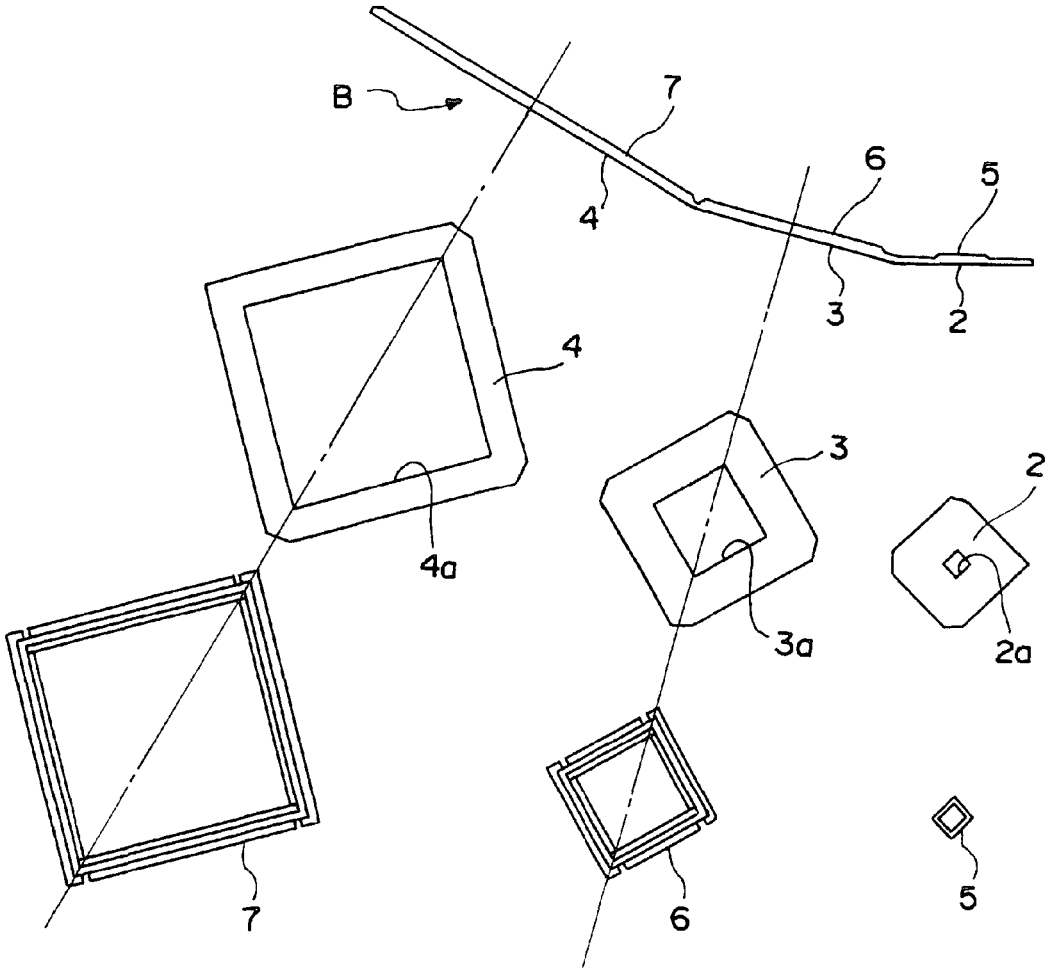
FIG. 6 shows a structure for explaining an example in which plane light emitters are mounted on the respective frames combined into a unit.

FIGS. 5 and 6 are for explaining an example in which the plane light emitters 5, 6, and 7 are respectively mounted to the above-mentioned frames 2, 3, and 4. As shown in FIG. 5, in this preferred embodiment, one unit is constituted by a combination of the frame 2, frame 3, and frame 4 which respectively constitute the light emitting units of the above-mentioned first-third rings. In other words, 12 units of combinations as shown in FIG. 5 are prepared and connected annularly so as to form the lighting apparatus as shown in FIGS. 1-4.

As shown in FIG. 5, a stainless steel plate is used for each of the frames 2, 3, and 4 which constitute one unit, and subjected to decoration processing, such as for example hairline processing etc. Further, window holes 2*a*, 3*a*, and 4*a* which are formed substantially square are respectively formed at the frames 2, 3, and 4. Light emitting sides of organic EL elements functioning as plane light emitters 5, 6, and 7 at the back are provided so as to face the above-mentioned window holes 2*a*, 3*a*, and 4*a*. In this way, the light emitting sides of the above-mentioned plane light emitters 5, 6, and 7 are provided so that they are framed at the respective window holes 2*a*, 3*a*, and 4*a*.

The above-mentioned one unit is shown as B in FIG. 6 which is a sectional view taken along line A-A of FIG. 5. As shown in FIG. 6 as B, on the basis of the frame 2 which constitutes the light emitting unit of the first ring, the frame 3 which constitutes the light emitting unit of the second ring is bent at an angle of approximately 15°, and the frame 4 which constitutes the light emitting unit of the third ring is further bent at an angle of approximately 15° in the same direction. In this way, the plane light emitters 5, 6, and 7 sides at the respective frames 2, 3, and 4 are arranged to form a dome shape, as described above.

In addition, FIG. 6 shows relationships among the respective frames 2, 3, and 4 and the plane light emitters 5, 6, and 7 which are provided at the respective backs of the frames. Desirably, the above-mentioned plane light emitters 5, 6, and 7 employ the organic EL element. As is well known, in the organic EL element, a transparent electrode made of ITO etc. is formed as a film on a transparent substrate surface by a sputtering process, for example. On the film, a light-emitting functional layer made of an organic material and a metal back electrode mainly made of an aluminum material etc. can be formed as films by way of a vacuum deposition process, for example.

According to the organic EL element having such a structure, it is arranged that the light from the above-mentioned light-emitting functional layer comes out through the above-mentioned transparent electrode and the substrate made of a transparent material. Further, although it is preferable that a luminescence color of the organic EL element generally is white, it is possible to employ various luminescence colors, as desired, by selecting a material for the light-emitting functional layer.

According to the above-mentioned structure, the number of the plane light emitters of different sizes 5, 6, and 7 which constitute the light emitting units of the first-third rings is 36, therefore it is possible to realize various lighting operations, including a blink operation, such as lighting for each ring, lighting the light emitting units of one ring intermittently, etc.

As is seen from the above description, according to the lighting apparatus in accordance with the present invention, it is arranged that the planar frames having mounted thereon the plane light emitter are connected mutually and annularly so as to constitute the light emitting units of one ring and a plurality of light emitting units of other rings are similarly arranged concentrically, so to speak. Thus, it is possible to obtain the operational effects as described above, such as an excellent decoration effect, as compared with an image of the lighting apparatus using a conventional fluorescent light, an electric bulb, etc.

In addition, in the preferred embodiment as described above, although each of the planar frames and plane light emitters which constitute the light emitting units of the first-third rings is formed to be square, their shapes may be of other shapes, such as for example a round shape etc. and allow the same operational effect. Further, in the preferred embodiment, although the annularly connected light emitting units are arranged to have three different diameters, the number of diameters may be set up arbitrarily.

Furthermore, in the lighting apparatus in accordance with the present invention, while the organic EL element is desirably used as the plane light emitter, it is also possible to use plane light emitting elements, such as an inorganic EL element etc. instead.

What is claimed is:

1. A ceiling-hung lighting apparatus in which a central part side of the lighting apparatus is arranged to project downwards to form a dome shape, comprising: light emitting units of a plurality of rings including at least the light emitting units of a first ring having a vacant center arranged such that a plurality of planar frames each having mounted thereon a plane light emitter are connected mutually and annularly by connecting adjacent frames of the plurality of planar frames, and the light emitting units of a second ring arranged such that a plurality of planar frames each having mounted thereon a plane light emitter are connected mutually and annularly by connecting adjacent frames of the plurality of planar frames, each frame circumscribing a perimeter of a respective one of said frames which constitute the light emitting units of said first ring, wherein plane light emitters of the light emitting units of the first ring have a same size and planar frames of the light emitting units of the first ring have a same size, plane light emitters of the light emitting units of the second ring have a same size and planar frames of the light emitting units of the second ring have a same size, each plane light emitter of the light emitting units of the second ring larger than that of the first ring and each planar frame of the light emitting units of the second ring is larger than that of the first ring, the numbers of frames which constitute the light emitting units of respective rings are set as the same number for the light emitting units of the respective rings, and the planar frames of the light emitting units of the second ring are connected at a predetermined angle to the planar frames of the light emitting units of the first ring so as to form the dome shape projecting toward a plane light emitter side.

2. The lighting apparatus as claimed in claim 1, wherein it is constituted by the light emitting units of a third ring, plane light emitters of the light emitting units of the third ring have a same size and the plane light emitters of the light emitting units of the third ring are arranged at a larger size than that of the second ring, each of the frames which constitute the light emitting units of each ring is formed to be square, and opposed corner portions of the respective frames are connected together annularly, so that the light emitting units of said first-third rings are respectively arranged.

3. The lighting apparatus as claimed in claim 1, wherein said plane light emitters are constituted by organic EL elements.

4. The lighting apparatus as claimed in claim 1 or 2, wherein lighting of the plane light emitters is operated for each ring.

5. The lighting apparatus as claimed in claim 1 or 2, wherein lighting of the plane light emitters in respective rings is operated for every arbitrary number of light emitting units.

* * * * *